US006193444B1

(12) United States Patent
Jonninen

(10) Patent No.: US 6,193,444 B1
(45) Date of Patent: Feb. 27, 2001

(54) IN-SITU BLENDING AND TRANSFERRING OF EARTH MATERIALS

(75) Inventor: Markku Jonninen, Lahti (FI)

(73) Assignee: Ideachip Oy Insinooritoimisto, Hollola (FI)

( * ) Notice: Subject to any disclaimer, the term of this patent is extended or adjusted under 35 U.S.C. 154(b) by 0 days.

(21) Appl. No.: 09/165,572

(22) Filed: Oct. 2, 1998

(30) Foreign Application Priority Data

Oct. 2, 1997 (FI) ..... 973866

(51) Int. Cl.[7] ..... E02D 3/00

(52) U.S. Cl. ..... 405/258; 37/352; 405/263; 299/79.1

(58) Field of Search ..... 37/301, 302, 303, 37/903, 404, 466, 347, 352, 365; 299/39.4, 78, 79.1; 404/91; 405/258, 263; 172/554

(56) References Cited

U.S. PATENT DOCUMENTS

| | | | | |
|---|---|---|---|---|
| 3,843,763 | * | 10/1974 | Sigott | 299/85 |
| 4,164,104 | * | 8/1979 | Kogler et al. | 299/75 |
| 4,641,889 | * | 2/1987 | Brandl | 299/75 |
| 4,786,112 | * | 11/1988 | Brandl | 299/76 |
| 5,478,139 | * | 12/1995 | Scott | 299/76 |
| 5,555,652 | * | 9/1996 | Ashby | 37/189 |
| 5,931,605 | * | 8/1999 | Toor et al. | 405/258 |
| 5,975,644 | * | 11/1999 | Lang | 299/39.4 |
| 6,017,169 | * | 1/2000 | Toor et al. | 405/258 |

FOREIGN PATENT DOCUMENTS

| | | |
|---|---|---|
| 1 162 862 | 2/1964 | (DE) . |
| 25 15 193 A1 | 10/1976 | (DE) . |
| 3023 002 A1 | 1/1982 | (DE) . |
| WO 94/13888 | 6/1994 | (WO) . |

OTHER PUBLICATIONS

ITEX Book Brochure "In–Situ Blending Systems" (Undated).*

* cited by examiner

*Primary Examiner*—Eileen D. Lillis
*Assistant Examiner*—John Kreck
(74) *Attorney, Agent, or Firm*—Synnestvedt & Lechner LLP

(57) ABSTRACT

A method and apparatus for blending and transferring earth material at a blending site. The apparatus has a sinking shank mounted on the end of a boom of a working machine. Two cutter drums are mounted in spaced relation on the end of the shank for rotation about a horizontal axis. The working machine is advanced toward the blending site. The cutter drums are sunk into the earth material at the blending site and rotated to effect blending. The cutter drums are drawn toward the working machine to further effect blending and transfer a portion of the blended earth material to an accumulation of blended earth material over which the working machine advances.

15 Claims, 2 Drawing Sheets

IN-SITU BLENDING AND TRANSFERRING OF EARTH MATERIALS

FIELD OF THE INVENTION

The invention relates to a method and an apparatus for blending and transferring earth material and especially to blending a mixture material directly with earth material.

BACKGROUND OF THE INVENTION

There are many instances where it is desirable to effect the blending and transfer of earth material. Several such examples include:

1. the construction of load-bearing slabs or road beds by blending on-site soil layers with suitable mixture materials such as cement (used as a binder) power plant ash for improved density and various chemicals which promote settling and stabilization of the mixture;

2. the microbiological decontamination of soil can be initiated or intensified by blending microbes into the soil or by modifying the soil conditions in a way favorable for biological activity, such as decomposition;

3. the stabilization of earth material by blending suitable additives for solidifying or setting the soil, whereby contaminants such as toxins or oil can be trapped in the stabilized layer to reduce the diffusion of contamination to neighboring regions;

4. the manufacture of bentonite insulation can be effected by blending bentonite with on-site earth material;

5. the manufacture of concrete by blending and transferring the constituent components comprising the concrete.

The blending and transferring process can improve the efficiency of various tasks, for example, by eliminating the need for lifting and replacing masses of soil in the aforementioned stabilization and decontamination activities or by replacing piling and mixing in the manufacture of concrete.

Thus far, there has been no method or apparatus available which is capable of blending and transferring mixture materials with earth material efficiently and to a sufficient depth directly on-site.

DETAILED DESCRIPTION OF THE PREFERRED EMBODIMENT

Figure 1:
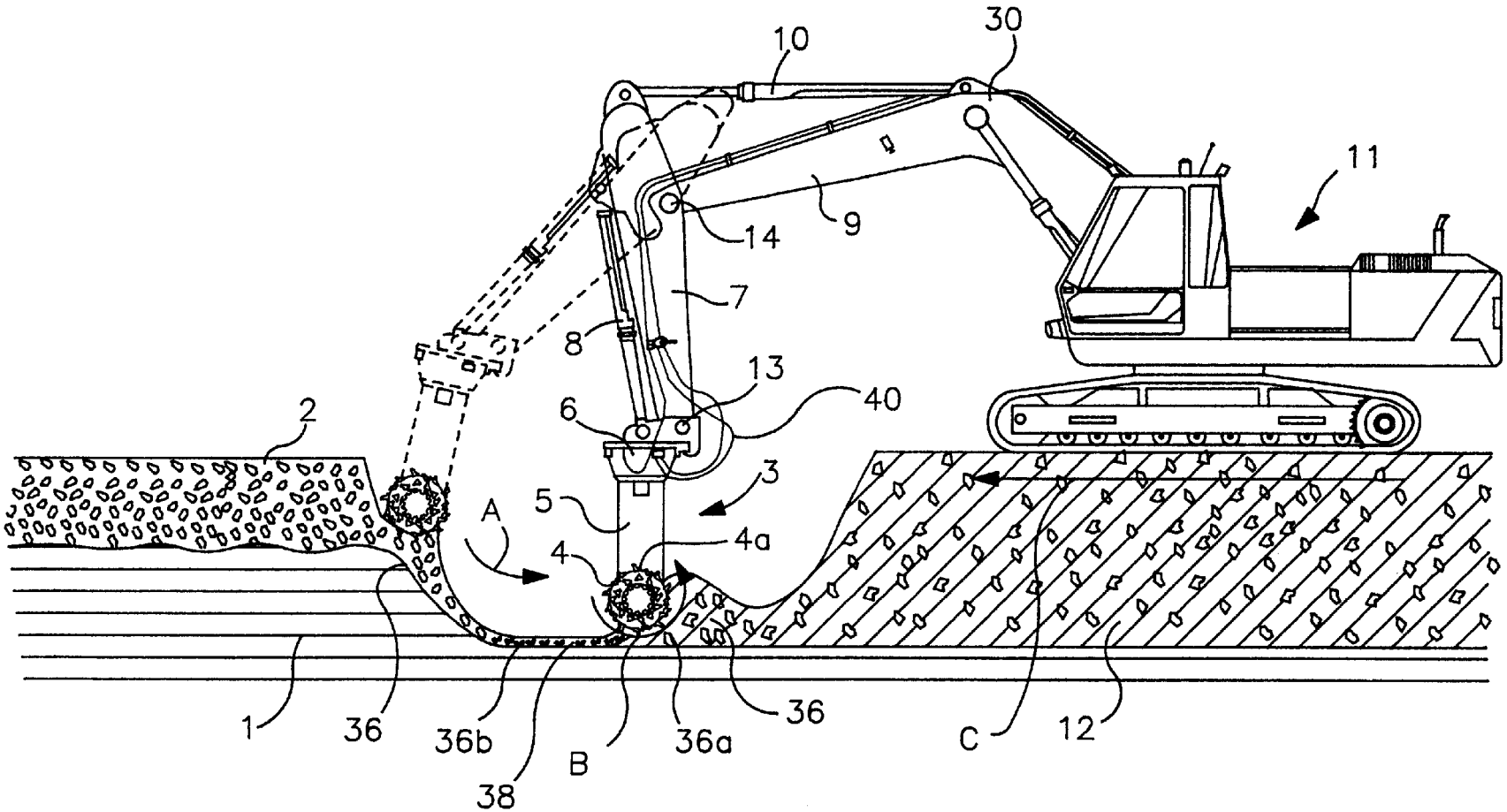
FIG. 1 illustrates a method and apparatus for blending and transferring earth material at a blending site according to the invention.

The method of blending and transferring earth material at a blending site is described with reference to FIG. 1. A mixture material layer 2 is preferably laid directly on top of earth material 1 with which it is to be blended. An apparatus 3 for blending and transferring earth material is mounted on the end of a boom 30 of a working machine 11. Boom 30 comprises arms 7 and 9, which are attached to each other by means of hinge joint 14. Blending and transferring apparatus

3 is mounted on the end of boom 30, being connected to arm 7 by way of a hinge joint 13. A cylinder 8 is used for maneuvering the blending and transferring apparatus 3 around the hinge joint 13 relative to arm 7. Another cylinder 10 is used for maneuvering the arm 7 around the hinge joint 14 relative to arm 9.

Blending and transferring apparatus 3 comprises a sinking shank 5 and a pair of cutter drums 4 mounted on the end of the sinking shank. Cutter drums 4 are mounted for rotation about a substantially horizontal axis 32 (see FIG. 2) and are rotated in a direction indicated by arrow "B" (see FIG. 1) in which the top portion 4*a* of each drum travels in the advancing direction of the working machine 11 depicted by the arrow "C". This direction of rotation tends to pull drums 4 away from the working machine.

FIG. 1 illustrates the method of blending and transferring a portion 36 of earth material at a blending site 38 to form an accumulation of blended earth material 12 at the site. The blending is shown using two layers of material labeled 1 and 2 for clarity of illustration, it being understood that the method contemplates more or fewer layers being blended and transferred.

In the method according to the invention, the working machine 11 is advanced toward the blending site 38 in the direction of arrow "C" in FIG. 1. Cutter drums 4, shown in dashed line, are sunk into a portion 36 of the earth material 1 (which, for example, could be a layer of soil) and the mixture layer 2. Preferably, the cutter drums are sunk to a depth between about 0.5 to about 2 meters. The cutter drums are rotated about the horizontal axis 32, as described above, to effect blending of material from layer 2 with the portion 36 of earth material 1, the cutter drums being displaced or drawn toward the working machine as indicated by the arrow labeled "A". The displaced position of the cutter drums is shown in solid line in FIG. 1. Portion 36 of the earth material is blended with the mixture material by the rotating action of the drums, and in drawing the drum toward the working machine as indicated at arrow "A", the portion 36 is further blended and transferred toward the working machine to form the accumulation of blended earth material 12 over which the working machine advances. The apparatus 3 is repeatedly worked in this way in the direction of arrow "A" to blend layers 1 and 2 and transfer or displace portion 36 across the blending site 38 to form the accumulation 12. Preferably, the cutter drums 4 have a rotating speed within the range of 50–150 rpm. This speed range provides mixing efficiency and causes a first quantity 36*a* of portion 36 beneath the cutter drums to be transferred toward the working machine 12 while a second quantity, 36*b*, is carried over the top portion 4*a* of cutter drums 4 and is transferred away from the working machine 11, where it blends further with the earth and mixture material at the blending site 38.

Figure 3:
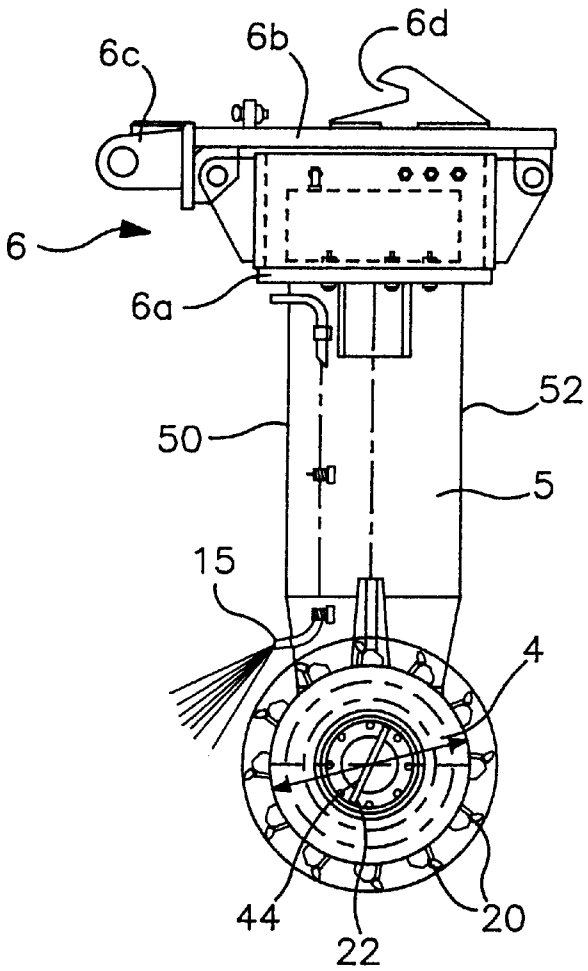
FIG. 3 shows a side view of the apparatus shown in FIG. 1 on an enlarged scale.

The mixture material layer 2 may be positioned on the earth material 1 by one of a number of methods such as laying the mixture material onto the earth material at the blending site or spraying the mixture material onto the earth material as illustrated at 15 in FIG. 3.

It is preferred that the sinking shank 5 have a sufficient length to bury the cutting drums 4 to a sufficient depth. Shank 5 should have a length which exceeds the diameter of the cutting drums in order to establish sufficient burying depth and a possibility of blending by slinging or transferring the second quantity of material away from the working machine back to the blending site 38 for further mixing. Preferably, the first quantity of earth material 36*a* transferred toward the working machine is greater than the second quantity 36*b* transferred away.

Figure 2:
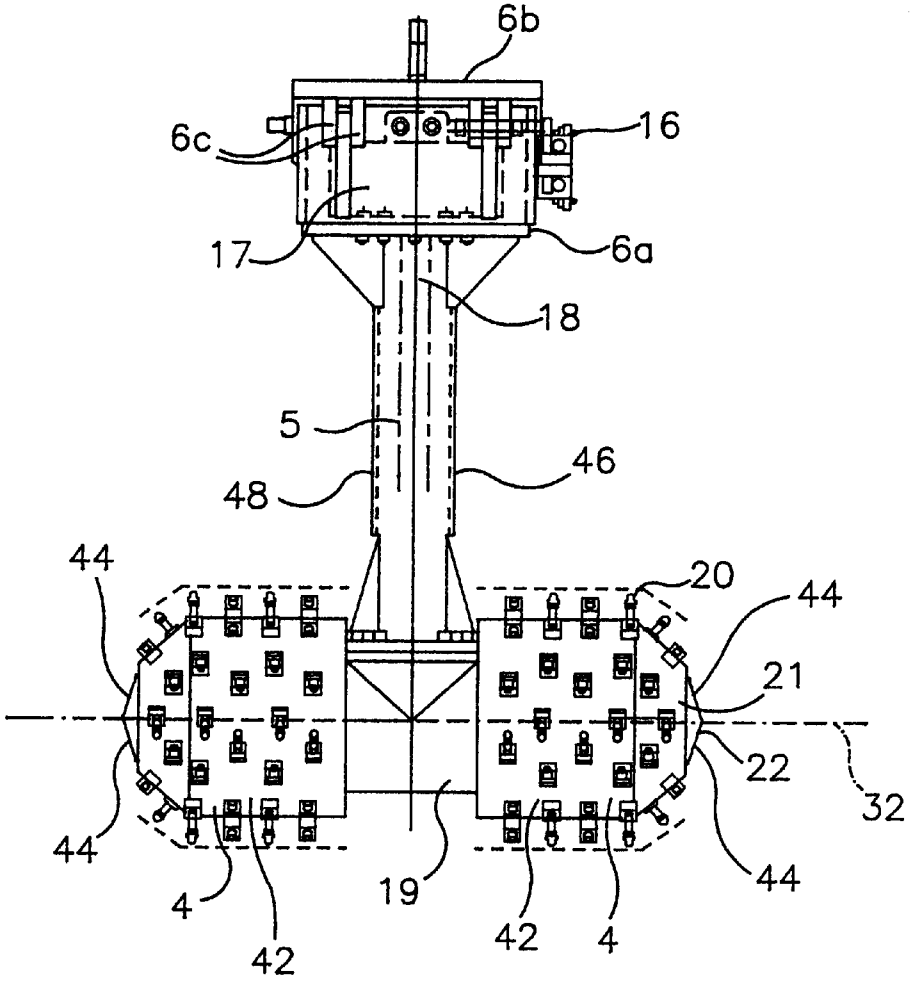
FIG. 2 shows a front view of the apparatus shown in FIG. 1 on an enlarged scale.

The preferred structural design of the blending and transferring apparatus according to the invention is shown in detail in FIGS. 2 and 3. The two cutter drums 4 are journaled at the end 19 of sinking shank 5 and rotatable about horizontal axis 32 which is oriented substantially perpendicularly to the sinking shank as seen in FIG. 2. Cutter drums 4 are mounted in spaced relation to one another with the sinking shank 5 between them. As seen in FIG. 1, the other end of the sinking shank is attached to arm 7 of boom 30 by means of fastening elements 6. In the illustrated embodiment, the fastening elements 6 include flanges 6*a* and 6*b* (see FIG. 2), which define therebetween a housing for a hydraulic motor 17 described below. The flange 6*b* is fitted with an apertured engagement bracket 6*c* and an engagement bracket provided with a clamping slot 6*d* best shown in FIG. 3.

Each cutter drum 4 has a cylindrical body portion 42 with an outer end portion 21, preferably in the shape of a truncated cone, and terminating in an outwardly facing cutting bit formed by a plate 22. Each plate 22 is positioned substantially parallel to axis 32 and has a pair of cutting edges 44 oriented angularly with respect to the axis, thereby forming a triangular shape. The outwardly facing cutter bits formed by plates 22 prevent the cutter drums from becoming jammed between soil layers flanking the apparatus 3.

Means for rotating the cutter drums 4 about axis 32 are provided by transmission shaft 18 which extends inside sinking shank 5 and is driven by hydraulic motor 17 preferably located at the end of the sinking shaft connected to boom 30. Hydraulic motor 17 has external couplings 16 (see FIG. 2) for connecting hydraulic lines 40 (see FIG. 1) from the working machine 11 to the motor 17. Bevel gears (not shown) located within the end 19 of the sinking shank are used to effect rotation of the cutter drums 4 by the shaft 18. Preferably, both of the cutter drums rotate in the same direction. The hydraulic motor 17 can also be placed inside the end 19 of sinking shank 5. In this design, couplings 16 must be located within the end 19 of the sinking shank since the subsurface part of the apparatus cannot be provided with external fragile components.

The length of the sinking shank 5 is chosen according to the application for which the apparatus is employed. In practice, the bottom surface of the cutter drums has a maximum sinking depth within the range of 1.5 to 2 meters and required blending depths are within the range of 0.5 to 2 meters. Preferably, each cutter drum 4 has an axial length with is substantially equal to its diameter. However, the ratios between these dimensions may fluctuate according to the apparatus' application and depending upon the required mixing depth and hardness of the earth material.

As mentioned above, and shown in FIG. 3, the sinking shank is provided with a pipe 15 for delivering a variety of sprayable mixture materials, such as chemical or microbial solutions, to the blending site.

The cylindrical body portion 42 of the cutter drums is provided with conical projections 20 which are angularly oriented with respect to a radius extending from the cutter drum as best seen in FIG. 3. In order to facilitate the blending and transferring actions of the apparatus, sinking shank 5 is narrower along the dimension between the opposite sides 46 and 48 where the cutter drums are mounted than along the dimension between the sides 50 and 52 perpendicular to sides 46 and 48 as readily seen by a comparison of FIGS. 2 and 3. The relative narrowness of the sinking shank allows for easier passage of earth material on either side of it when the shank is drawn toward the working machine.

As shown in FIG. 1, in a typical working position of the apparatus 3 the sinking shank 5 is held in a substantially vertical position and manipulated on either side of a vertical reference line by moving the sinking shank back and forth from the vertical position toward and away from the working machine. An essential feature of the invention is that the working direction "A" of the apparatus 3 during blending and transferring action proceeds toward the working machine 11, the direction of arrow "A" being reversed relative to the advancing direction of the working machine defined by arrow "C".

The method of the invention can be implemented by using an apparatus whose structural details differ in many ways from the above described exemplary embodiment. All that is necessary for an apparatus implementing the method is that it includes one or more rotatable cutter drums mounted on the end of a sufficiently long sinking shaft 5.

What is claimed is:

1. A method of blending and transferring a portion of earth material at a blending site to form an accumulation of blended earth material at said site using a cutter drum mounted for rotation about a substantially horizontal axis on the end of a sinking shank, said sinking shank being attached to a boom of a working machine, said method comprising the steps of:

advancing said working machine in the direction of said blending site;

sinking said cutter drum into said portion of earth material at said blending site;

rotating said cutter drum about said substantially horizontal axis to effect said blending of said portion, said axis being oriented perpendicularly to the direction of advance of said working machine, the direction of rotation tending to pull said drum away from said working machine;

transferring and further blending said portion of said earth material by drawing said cutter drum toward said working machine to form said accumulation of blended earth material.

2. A method of blending and transferring earth material according to claim 1, further comprising the step of positioning a layer of mixture material at said blending site, said mixture material being blended with earth material by said method.

3. A method of blending and transferring earth material according to claim 2, wherein said positioning step comprises laying said mixture material on earth material at said blending site.

4. A method of blending and transferring earth material according to claim 2, wherein said positioning step comprises spraying said mixture material on earth material at said blending site.

5. A method of blending and transferring earth material according to claim 1, wherein said sinking step comprises sinking said cutter drum into earth material at said blending site to a depth of between about 0.5 meters to about 2 meters.

6. A method of blending and transferring earth material according to claim 5, wherein said rotating step comprises rotating said cutter drum at a speed between about 50 rpm to about 150 rpm.

7. A method of blending and transferring earth material according to claim 5, wherein said transferring step comprises positioning said sinking shank in a substantially vertical position and moving said sinking shank back and forth from said vertical position toward and away from said working machine.

8. A method of blending and transferring earth material according to claim 1, wherein said first quantity of said portion of earth material is greater than said second quantity.

9. A method of blending and transferring earth material according to claim 1, wherein a first quantity of said portion beneath said cutter drum is transferred toward said working machine, and a second quantity of said portion is carried over said cutter drum and transferred away from said working machine and blended with earth material at said blending site.

10. An apparatus for blending and transferring earth material, said apparatus being mountable on a boom of a working machine and comprising:

an elongated sinking shank having opposed ends, one of said ends being attachable to said boom;

two cutter drums rotatably mounted on the other end of said sinking shank in spaced relation to each other on opposite sides of said sinking shank, said cutter drums being rotatable about an axis oriented substantially perpendicularly to said sinking shank, each of said cutter drums having a cylindrical body portion with an outer end portion terminating in an outwardly facing cutting bit, each of said cutting bits comprising a plate positioned substantially parallel to said axis and having a pair of cutting edges oriented angularly with respect to said axis; and means for rotating said cutter drums about said axis.

11. An apparatus according to claim 10, further comprising a plurality of conical projections extending outwardly from each of said cutter drums, said projections being angularly oriented with respect to a radius extending from said cutter drums.

12. An apparatus according to claim 10, wherein each of said body portions of said cutter drums has an axial length substantially equal to its diameter.

13. An apparatus according to claim 10, wherein said sinking shank is narrower between said opposite sides than between the sides perpendicular to said opposite sides.

14. An apparatus according to claim 10, wherein said means for rotating said cutter drums comprises a hydraulic motor positioned at the one end of said sinking shank, and a transmission shaft extending through said sinking shank and engaging said hydraulic motor and said cutter drums, said hydraulic motor rotating said cutter drums through said transmission shaft.

15. An apparatus according to claim 10, wherein said outer end portions of said cutter drums have the shape of a truncated cone.

* * * * *